US009151222B2

(12) United States Patent
Svensson

(10) Patent No.: US 9,151,222 B2
(45) Date of Patent: Oct. 6, 2015

(54) SIX-STROKE COMBUSTION CYCLE ENGINE AND PROCESS

(71) Applicant: Caterpillar Inc., Peoria, IL (US)

(72) Inventor: Kenth Svensson, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/712,145

(22) Filed: Dec. 12, 2012

(65) Prior Publication Data

US 2014/0158071 A1 Jun. 12, 2014

(51) Int. Cl.

| | |
|---|---|
| ***F02B 75/02*** | (2006.01) |
| *F02B 1/00* | (2006.01) |
| *F02F 1/24* | (2006.01) |
| *F02B 1/04* | (2006.01) |
| *F02B 3/06* | (2006.01) |

(52) U.S. Cl.

CPC ..... *F02B 75/021* (2013.01); *F02B 1/00* (2013.01); *F02B 1/04* (2013.01); *F02B 3/06* (2013.01); *F02F 2001/247* (2013.01)

(58) Field of Classification Search

CPC ..... F02B 75/021; F02B 1/00; F02B 1/04; F02B 3/06; F02F 2001/247

USPC ..... 123/64

See application file for complete search history.

(56) References Cited

U.S. PATENT DOCUMENTS

| | | | | |
|---|---|---|---|---|
| 4,179,892 | A | 12/1979 | Heydrich | |
| 4,736,715 | A | 4/1988 | Larsen | |
| 4,917,054 | A * | 4/1990 | Schmitz | 123/58.8 |
| 5,224,460 | A | 7/1993 | Havstad et al. | |
| 5,284,116 | A | 2/1994 | Richeson, Jr. | |
| 5,564,275 | A | 10/1996 | Codan et al. | |
| 6,209,324 | B1 | 4/2001 | Daudel et al. | |
| 6,293,092 | B1 | 9/2001 | Ament et al. | |
| 6,295,817 | B1 | 10/2001 | Abthoff et al. | |
| 6,321,731 | B1 | 11/2001 | Russ et al. | |
| 6,324,847 | B1 | 12/2001 | Pierpont | |
| 6,332,446 | B1 | 12/2001 | Matsumoto et al. | |
| 6,491,016 | B1 | 12/2002 | Buratti | |
| 6,557,779 | B2 | 5/2003 | Perr et al. | |
| 6,564,758 | B1 | 5/2003 | Enderle et al. | |
| 6,619,241 | B2 | 9/2003 | Otterspeer et al. | |

(Continued)

FOREIGN PATENT DOCUMENTS

| | | |
|---|---|---|
| JP | 03-115743 | 5/1991 |
| WO | WO 2009/081227 A1 | 7/2009 |
| WO | WO 2010/075165 A1 | 7/2010 |

*Primary Examiner* — Lindsay Low
*Assistant Examiner* — Charles Brauch
(74) *Attorney, Agent, or Firm* — Leydig, Voit & Mayer, Ltd.

(57) ABSTRACT

A fuel introduction system introduces fuel to an internal combustion engine operating on a six-stroke combustion cycle including a first compression stroke, a first power stroke, a second compression stroke, and a second power stroke. The fuel introduction system includes a first orifice set for introducing a first fuel charge to a combustion chamber of the engine during the first compression stroke and/or power stroke and a second orifice set for introducing a second fuel charge to the combustion chamber during the second compression stroke and/or power stroke. Combustion of the second fuel charge can assist in burning particulate matter left in the combustion chamber from combusting the first fuel charge. The first and second orifice sets can be configured to differentiate the first and second fuel charges by, for example, fuel quantity or spray pattern.

20 Claims, 7 Drawing Sheets

(56) References Cited

U.S. PATENT DOCUMENTS

| | | | | |
|---|---|---|---|---|
| 6,622,693 | B2 | 9/2003 | Arndt et al. | |
| 6,705,543 | B2 | 3/2004 | Carroll, III et al. | |
| 6,758,174 | B1 | 7/2004 | Fuerhapter | |
| 6,772,742 | B2 | 8/2004 | Lei et al. | |
| 6,807,956 | B2 | 10/2004 | Gaessler et al. | |
| 6,941,746 | B2 | 9/2005 | Tarabulski et al. | |
| 6,966,505 | B2 | 11/2005 | Peterson, Jr. | |
| 7,031,821 | B2 | 4/2006 | Lewis et al. | |
| 7,096,848 | B2 | 8/2006 | Ono et al. | |
| 7,143,725 | B1 | 12/2006 | Hu | |
| 7,181,902 | B2 | 2/2007 | Naik | |
| 7,213,565 | B2 | 5/2007 | Grünaug et al. | |
| 7,264,785 | B2 | 9/2007 | Blakeman et al. | |
| 7,287,378 | B2 | 10/2007 | Chen et al. | |
| 7,418,928 | B2 | 9/2008 | Fiveland | |
| 7,422,000 | B2 | 9/2008 | Kesse et al. | |
| 7,426,916 | B2 | 9/2008 | Reed et al. | |
| 7,500,475 | B2 | 3/2009 | Raymond et al. | |
| 7,513,239 | B2 | 4/2009 | Blessing et al. | |
| 7,556,017 | B2 | 7/2009 | Gibson | |
| 7,597,865 | B2 | 10/2009 | Mori et al. | |
| 7,673,590 | B2 | 3/2010 | Reed et al. | |
| 7,685,990 | B2 | 3/2010 | Dingle | |
| 7,726,268 | B2 | 6/2010 | Kelem et al. | |
| 7,763,222 | B2 | 7/2010 | Miyairi et al. | |
| 7,867,598 | B2 | 1/2011 | Miyairi et al. | |
| 7,891,345 | B2 | 2/2011 | Pierpont | |
| 8,051,659 | B2 | 11/2011 | Yamashita et al. | |
| 8,096,279 | B2 | 1/2012 | Kuzuyama | |
| 8,136,504 | B2 | 3/2012 | Winstead | |
| 8,141,352 | B2 | 3/2012 | Tsujimoto et al. | |
| 2003/0010320 | A1* | 1/2003 | Gillis et al. | 123/468 |
| 2008/0257304 | A1* | 10/2008 | Noda et al. | 123/305 |
| 2009/0145382 | A1 | 6/2009 | Kawai | |
| 2010/0050963 | A1 | 3/2010 | Ooyama | |
| 2010/0212300 | A1 | 8/2010 | Fiveland et al. | |
| 2010/0269775 | A1* | 10/2010 | Chandes et al. | 123/1 A |
| 2011/0162349 | A1 | 7/2011 | Cheng et al. | |
| 2011/0197852 | A1 | 8/2011 | Meyman | |

* cited by examiner

SIX-STROKE COMBUSTION CYCLE ENGINE AND PROCESS

TECHNICAL FIELD

This patent disclosure relates generally to internal combustion engines and, more particularly, to internal combustion engines that are configured to operate on a six-stroke internal combustion cycle.

BACKGROUND

Internal combustion engines operating on a six-stroke cycle are generally known in the art. In a six-stroke cycle, a piston reciprocally disposed in a cylinder moves through an intake stroke from a top dead center (TDC) position to a bottom dead center (BDC) position to admit air, an air/fuel mixture, and/or an air/exhaust gas mixture into the cylinder. During a compression stroke, the piston moves towards the TDC position to compress the air or the air/fuel/exhaust gas mixture. During this process, an initial or additional fuel charge may be introduced to the cylinder by an injector. Ignition of the compressed mixture increases the pressure in the cylinder and forces the piston towards the BDC position during a first power stroke. In accordance with the six-stroke cycle, the piston performs a second compression stroke in which it recompresses the combustion products remaining in the cylinder after the first combustion or power stroke. During this recompression, any exhaust valves associated with the cylinder remain generally closed to assist cylinder recompression. Optionally, a second fuel charge may be introduced into the cylinder during recompression to assist igniting the residual combustion products and produce a second power stroke. Following the second power stroke, the cylinder undergoes an exhaust stroke with the exhaust valve or valves open to substantially evacuate combustion products from the cylinder. One example of an internal combustion engine configured to operate on a six-stroke cycle can be found in U.S. Pat. No. 7,418,928. This disclosure relates to a method of operating an engine that includes compressing part of the combustion gas after a first combustion stroke of the piston as well as an additional combustion stroke during a six-stroke cycle of the engine.

Some possible advantages of the six-stroke cycle over the more common four-stroke cycle can include reduced emissions and improved fuel efficiency. For example, the second combustion event and second power stroke can provide for a more complete combustion of soot and/or fuel that may remain in the cylinder after the first combustion event. However, the additional piston strokes and fuel charges may increase the complexity of the internal combustion engine and its operation. The present disclosure is directed to addressing the increased complexity of the engine.

SUMMARY

In one aspect, the disclosure provides an internal combustion engine system operating on a six-stroke cycle including a first compression stroke, a first power stroke, a second compression stroke, and a second power stroke. The engine system includes a combustion chamber with a piston reciprocally disposed in a cylinder and moving up and down between a top dead center position and a bottom dead center position. The system also includes a fuel introduction system associated with the combustion chamber. The fuel introduction system has a first orifice set and a second orifice set with the first orifice set dedicated to introducing fuel only during at least one of the first compression stroke and/or the first power stroke.

In another aspect, the disclosure describes a method of operating an internal combustion engine utilizing a six-stroke cycle. The method includes providing a combustion chamber having a piston movable in a cylinder through at least a first compression stroke, a first power stroke, a second compression stroke, and a second power stroke. The method introduces a first fuel charge to the combustion chamber through a first orifice set during at least one of the first compression stroke and the first power stroke. Later, a second fuel charge is introduced to the combustion chamber through a second orifice set during at least one of the second compression stroke and the second power stroke.

The disclosure describes in yet further aspect another internal combustion engine system operating on a six-stroke cycle. The engine system includes a combustion chamber having a piston reciprocally disposed in a cylinder. The piston is movable through a first compression stroke, a first power stroke, a second compression stroke, and a second power stroke. The system also includes a fuel injector communicating with the combustion chamber and having a first orifice set and a second orifice set. A controller is included to control the fuel injector to open the first orifice set during at least one of the first compression stroke and first power stroke and to open the second orifice set during at least one of the second compression stroke and second power stroke.

DETAILED DESCRIPTION

This disclosure relates in general to an internal combustion engine and, more particularly, to one adapted to perform a six-stroke cycle for reduced emissions and improved fuel efficiency and other efficiencies. Internal combustion engines burn a hydrocarbon-based fuel or another combustible fuel source to convert the potential or chemical energy therein to mechanical power that can be utilized for work. In one embodiment, the disclosed engine may be a compression ignition engine, such as a diesel engine, in which air or a mixture of air and fuel are compressed in a cylinder to raise their pressure and temperature to a point at which auto-ignition or spontaneous ignition occurs. Such engines typically lack a sparkplug that is often associated with gasoline burning engines. However, in alternative embodiments, the utilization of different fuels such as gasoline and different ignition methods, for example, use of diesel as a pilot fuel to ignite gasoline or natural gas, are contemplated and fall within the scope of the disclosure.

Figure 1:
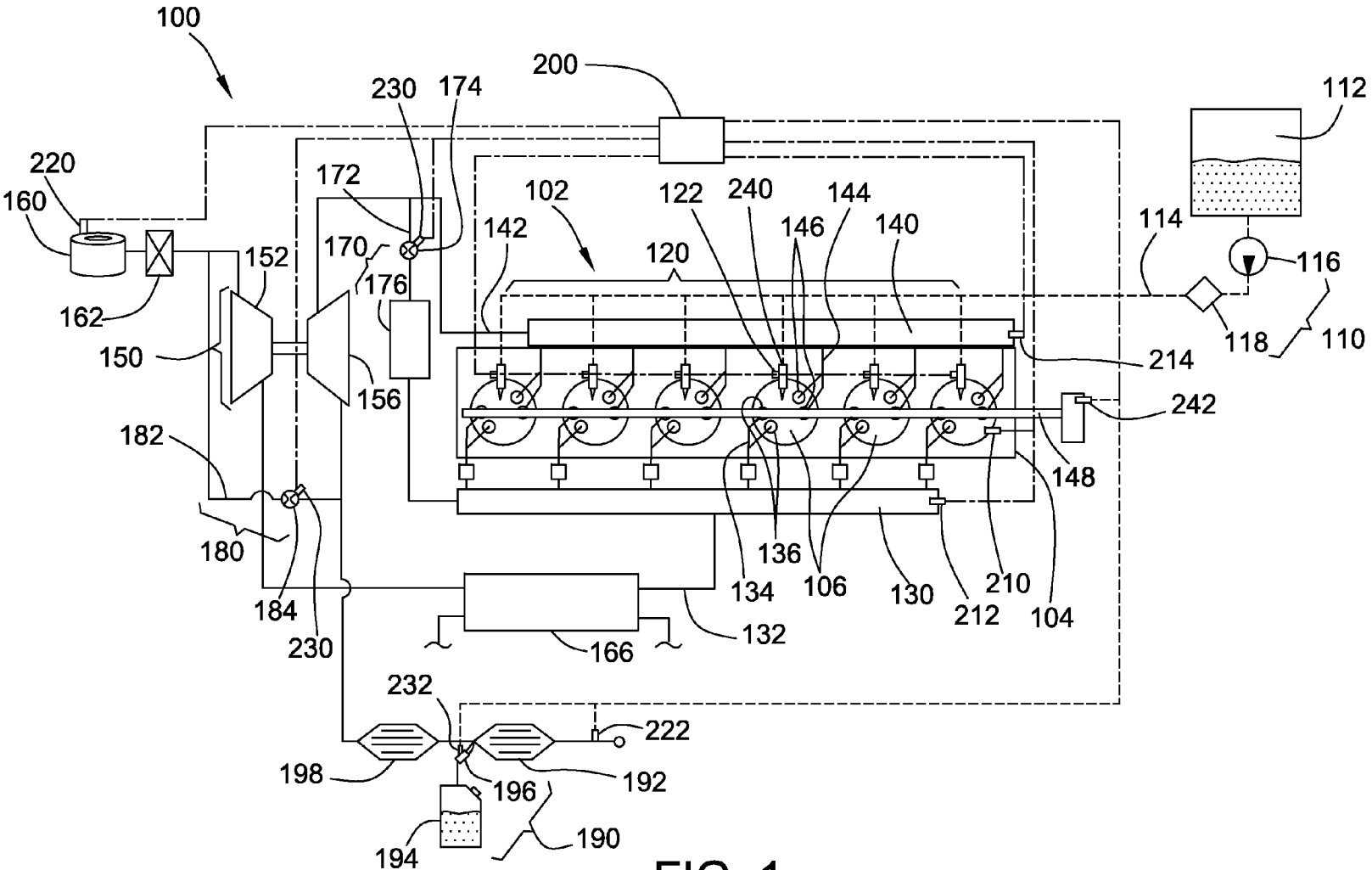
FIG. 1 is a block diagram of an engine system having an internal combustion engine adapted for operation in accordance with a six-stroke combustion cycle and certain associated systems and components for assisting the combustion process.

Now referring to FIG. 1, wherein like reference numbers refer to like elements, there is illustrated a block diagram representing an internal combustion engine system 100. The engine system 100 includes an internal combustion engine 102 and, in particular, a diesel engine that combusts a mixture of air and diesel fuel. The illustrated internal combustion engine 102 includes an engine block 104 in which a plurality of combustion chambers 106 are disposed. Although six combustion chambers 106 are shown in an inline configuration, in other embodiments fewer or more combustion chambers may be included or another configuration such as a V-configuration may be employed. The engine system 100 can be utilized in any suitable application including mobile applications such as motor vehicles, work machines, locomotives or marine engines, and in stationary applications such as electrical power generators.

To supply the fuel that the engine 102 burns during the combustion process, a fuel system 110 is operatively associated with the engine system 100. The fuel system 110 includes a fuel reservoir 112 that can accommodate a hydrocarbon-based fuel such as liquid diesel fuel. Although only one fuel reservoir is depicted in the illustrated embodiment, it will be appreciated that in other embodiments additional reservoirs may be included that accommodate the same or different types of fuels that the combustion process may also burn. Because the fuel reservoir 112 may be situated in a remote location with respect to the engine 102, a fuel line 114 can be disposed through the engine system 100 to direct the fuel from the fuel reservoir to the engine. To pressurize the fuel and force it through the fuel line 114, a fuel pump 116 can be disposed in the fuel line. An optional fuel conditioner 118 may also be disposed in the fuel line 114 to filter the fuel or otherwise condition the fuel by, for example, introducing additives to the fuel, heating the fuel, removing water and the like.

To introduce the fuel to the combustion chambers 106, the fuel system 110 can be operatively associated with a fuel introduction system 120. In the illustrated embodiment, the fuel introduction system 120 includes one fuel injector 122 associated with each combustion chamber and in fluid communication with the fuel line 114, but in other embodiments a different number of injectors per combustion chamber might be included. The fuel injectors 122 may be electrically actuated devices that are partially disposed into or access the combustion chamber 106 to selectively introduce a measured or predetermined quantity of fuel to each combustion chamber. To facilitate the six-stroke combustion process, the fuel injectors 122 can be configured to introduce fuel in two or more different fuel charges at different instances during the six-stroke cycle. As described in more detail below, the fuel injectors 122 can include two or more orifice sets having different sizes or injection characteristics that may be tailored specifically to the first and second fuel charges. Introducing the fuel in two different fuel charges and the corresponding two different combustion events can be correlated and balanced to improve fuel efficiency and/or reduce emissions. Although the illustrated embodiment depicts the fuel line 114 terminating at the fuel injectors 122, in other embodiments, the fuel line may establish a fuel loop that continuously circulates fuel through the plurality of injectors and, optionally, delivers unused fuel back to the fuel reservoir 112. Alternatively, the fuel line 114 may include a fuel collector volume or rail (not shown), which supplies pressurized fuel to the fuel injectors 122.

To supply the air that is combusted with the fuel in the combustion chambers 106, a hollow runner or intake manifold 130 can be formed in or attached to the engine block 104 such that it extends over or proximate to each of the combustion chambers. The intake manifold 130 can communicate with an intake line 132 that directs air to the internal combustion engine 102. Fluid communication between the intake manifold 130 and the combustion chambers 106 can be established by a plurality of intake runners 134 extending from the intake manifold. One or more intake valves 136 can be associated with each combustion chamber 106 and can open and close to selectively introduce the intake air from the intake manifold 130 to the combustion chamber. While the illustrated embodiment depicts the intake valves at the top of the combustion chamber 106, in other embodiments, the intake valves may be placed at other locations such as through a sidewall of the combustion chamber. To direct the exhaust gasses produced by combustion of the air/fuel mixture out of the combustion chambers 106, an exhaust manifold 140 communicating with an exhaust line 142 can also be disposed in or proximate to the engine block 104. The exhaust manifold 140 can communicate with the combustion chambers 106 by exhaust runners 144 extending from the exhaust manifold. The exhaust manifold 140 can receive exhaust gasses by selective opening and closing of one or more exhaust valves 146 associated with each combustion chamber 106.

To actuate the intake valves 136 and the exhaust valves 146, the illustrated embodiment depicts an overhead camshaft 148 that is disposed over the engine block 104 and operatively engages the valves. As will be familiar to those of skill in the art, the camshaft 148 can include a plurality of eccentric lobes disposed along its length that, as the camshaft rotates, cause the intake and exhaust valves 136, 146 to displace or move up and down in an alternating manner with respect to the combustion chambers 106. Movement of the valves can open and close ports leading into the combustion chamber. The placement or configuration of the lobes along the camshaft 148 controls or determines the gas flow through the internal combustion engine 102. As is known in the art, other methods exist for implementing valve timing such as actuators acting on the individual valve stems and the like. Furthermore, in other embodiments, a variable valve timing method can be employed that adjusts the timing and duration of actuating the intake and exhaust valves during the combustion process to simultaneously adjust the combustion process.

To assist in directing the intake air into the internal combustion engine 102, the engine system 100 can include a turbocharger 150. The turbocharger 150 includes a compressor 152 disposed in the intake line 132 that compresses intake air drawn from the atmosphere and directs the compressed air to the intake manifold 130. Although a single turbocharger 150 is shown, more than one such device connected in series and/or in parallel with another can be used. To power the compressor 152, a turbine 156 can be disposed in the exhaust line 142 and can receive pressurized exhaust gasses from the exhaust manifold 140. The pressurized exhaust gasses directed through the turbine 156 can rotate a turbine wheel having a series of blades thereon, which powers a shaft that causes a compressor wheel to rotate within the compressor housing. In other embodiments, the turbocharger may be electrically assisted and may be of a variable geometry style.

To filter debris from intake air drawn from the atmosphere, an intake air filter 160 can be disposed upstream of the compressor 152. In some embodiments, the engine system 100 may be open-throttled wherein the compressor 152 draws air directly from the atmosphere with no intervening controls or adjustability. In other embodiments, an adjustable governor or intake throttle 162 can be disposed in the intake line 132 between the intake air filter 160 and the compressor 152. Because the intake air may become heated during compression, an intercooler 166 such as an air-to-air heat exchanger can be disposed in the intake line 132 between the compressor 152 and the intake manifold 130 to cool the compressed air.

To reduce emissions generated by the combustion of air and fuel, the engine system 100 can mix the intake air with a portion of the exhaust gasses drawn from the exhaust system in a system or process referred to as exhaust gas recirculation (EGR). The EGR system forms an intake air/exhaust gas mixture that is introduced to the combustion chambers. In one aspect, addition of exhaust gasses to the intake air displaces the relative amount of oxygen in the combustion chamber during combustion that results in a lower combustion temperature and reduces the generation of nitrogen oxides. Two exemplary EGR systems, a high-pressure EGR system 170 and a low-pressure EGR system 180, are shown associated with the engine system 100 in FIG. 1, but it should be appreciated that these illustrations are exemplary and that either one, both, or neither can be used on the engine. The selection of an EGR system of a particular type may depend on the particular requirements of each engine application.

In the first embodiment, a high-pressure EGR system 170 operates to direct high-pressure exhaust gasses to the intake manifold 130. The high-pressure EGR system 170 includes a high-pressure EGR line 172 that communicates with the exhaust line 142 downstream of the exhaust manifold 140 and upstream of the turbine 156 to receive a portion of the high-pressure exhaust gasses before they have had a chance to depressurize through the turbine. The high-pressure EGR line 172 can direct the exhaust gasses to the intake manifold 130 where they can intermix with the intake air prior to combustion. To control and adjust the amount or quantity of the exhaust gasses combined with the intake air, an adjustable EGR valve 174 can be disposed along the high-pressure EGR line 172. Hence, the ratio of exhaust gasses mixed with intake air can be varied during operation by adjustment of the adjustable EGR valve 174. Because the exhaust gasses may be at a sufficiently high temperature that may affect the combustion process, the high-pressure EGR system can also include an EGR cooler 176 disposed along the high-pressure EGR line 172 either before or after the adjustable EGR valve 174 to cool the exhaust gasses.

In the second embodiment, a low-pressure EGR system 180 includes a low-pressure EGR line 182 that directs low-pressure exhaust gasses to the intake line 132. The low-pressure EGR line 182 communicates with the exhaust line 142 downstream of the turbine 156 so that it receives low-pressure exhaust gasses that have depressurized through the turbine, and delivers the exhaust gasses upstream of the compressor 152 so it can mix and be compressed with the incoming air. The system is thus referred to as a low-pressure EGR system because it operates using depressurized exhaust gasses. To control the quantity of exhaust gasses re-circulated, a second adjustable EGR valve 184 can be disposed in the low-pressure EGR line 182. The exhaust gasses and intake air can be cooled by the intercooler 166 disposed in the intake line 132.

The engine system 100 can include additional after-treatment devices to further reduce emissions from the combustion process. One example of an after-treatment device is a selective catalytic reduction (SCR) system 190. In an SCR system 190, the exhaust gasses are combined with a reductant agent such as ammonia or an ammonia precursor such as urea and are directed through a SCR catalyst 192 that chemically converts or reduces the nitrogen oxides in the exhaust gasses to nitrogen and water. For example, the reaction and reduction of nitrogen oxides can occur according to the following representative reaction:

$$NH_3+NO_X \rightarrow N_2+H_20 \quad (1)$$

The foregoing reaction is representative only and other reactions can be used to reduce nitrogen oxides. Any suitable material can be used for the SCR catalyst including, for example, vanadium, molybdenum, tungsten, and various zeolites. To provide the reductant agent used in the process, a separate storage tank 194 may be associated with the SCR system 190. An electrically-operated reductant agent injector 196 in fluid communication with the storage tank 194 can be disposed either in the exhaust line 142 upstream of the SCR catalyst 192 or directly into the SCR catalyst to introduce the reductant agent to the exhaust gasses. The process of introducing reductant agent is sometimes referred to as "dosing." Optionally, to mix the reductant agent and exhaust gasses, various mixers or pre-mixers can be disposed in the exhaust line 142.

Another example of an after-treatment device is a diesel oxidation catalyst (DOC) 198 coated with or including metals such as palladium and platinum that can convert hydrocarbons and carbon monoxide in the exhaust gasses to carbon dioxide. Representative reactions for this reaction are:

$$CO+\tfrac{1}{2}O_2 \rightarrow CO_2 \quad (2)$$

$$[HC]+O_2 \rightarrow CO_2+H_2O \quad (3)$$

In contrast to the SCR reaction, the DOC 198, by reacting components that are already present in the exhaust gasses, does not require a reductant agent. In various embodiments, the DOC 198 can be placed either upstream or downstream of the SCR catalyst. Other optional after-treatment systems that may be disposed in the exhaust system include a diesel particulate filter (DPF) that temporarily traps soot, three-way catalysts and the like.

To coordinate and control the various systems and components associated with the engine system 100, the system can include an electronic or computerized control unit, module or controller 200. The controller 200 is adapted to monitor various operating parameters and to responsively regulate various variables and functions affecting engine operation. The controller 200 can include a microprocessor, an application specific integrated circuit (ASIC), or other appropriate circuitry and can have memory or other data storage capabilities. The controller can include functions, steps, routines, data tables, data maps, charts and the like saved in and executable from read-only memory or another electronically accessible storage medium to control the engine system. Although in FIG. 1, the controller 200 is illustrated as a single, discrete unit, in other embodiments, the controller and its functions may be distributed among a plurality of distinct and separate components. To receive operating parameters and send control commands or instructions, the controller can be operatively associated with and can communicate with various sensors and controls on the engine system 100. Communication between the controller and the sensors can be established by sending and receiving digital or analog signals across electronic communication lines or communication busses. The various communication and command channels are indicated in dashed lines for illustration purposes.

For example, to monitor the pressure and/or temperature in the combustion chambers 106, the controller 200 may communicate with chamber sensors 210 such as a transducer or the like, one of which may be associated with each combustion chamber 106 in the engine block 104. The chamber sensors 210 can monitor the combustion chamber conditions directly or indirectly. For example, by measuring the back-pressure exerted against the intake or exhaust valves, the controller 200 can indirectly measure the pressure in the combustion chamber 106. The controller 200 can also communicate with an intake manifold sensor 212 disposed in the intake manifold 130 and that can sense or measure the conditions therein. To monitor the conditions such as pressure and/or temperature in the exhaust manifold 140, the controller 200 can similarly communicate with an exhaust manifold sensor 214 disposed in the exhaust manifold 140. From the temperature of the exhaust gasses in the exhaust manifold 140, the controller 200 may be able to infer the temperature at which combustion in the combustion chambers 106 is occurring.

To measure the flow rate, pressure and/or temperature of the air entering the engine, the controller 200 can communicate with an intake air sensor 220. The intake air sensor 220 may be associated with, as shown, the intake air filter 160 or another intake system component such as the intake manifold. The intake air sensor 220 may also determine or sense the barometric pressure or other environmental conditions including humidity in which the engine system is operating. To measure the quality of the exhaust gasses and/or emissions actually discharged by the engine system 100 to the environment, the controller can communicate with a system outlet sensor 222 disposed in the exhaust line 142 downstream of the after-treatment devices. Other sensors may monitor the engine out conditions at stages before and during after-treatment.

The controller 200 can also be operatively associated with either or both of the high-pressure EGR system 170 and the low-pressure EGR system 180 by way of an EGR control 230 associated with the adjustable EGR valves 174, 184. The controller 200 can thereby adjust the amount of exhaust gasses and the ratio of intake air/exhaust gasses introduced to the combustion process. In addition to controlling the EGR system, the controller can also be communicatively linked to a reductant agent injector control 232 associated with the reductant agent injector 196 to adjustably control the timing and amount of reductant agent introduced to the exhaust gasses.

To further control the combustion process, the controller 200 can communicate with injector controls 240 that can control the fuel injectors 122 of the fuel introduction system 120. The injector controls 240 can selectively activate or deactivate the fuel injectors 122 to determine the timing of introduction, the quantity of fuel introduced by and the injection pressure at each fuel injector. In particular, the injector controls 240 can work in conjunction with the fuel injectors 122 to produce and adjust the first and second fuel charges that provide the first and second combustion events during the six-stroke cycle. To further control the timing of the combustion operation, the controller 200 in the illustrated embodiment can also communicate with a camshaft control 242 that is operatively associated with the camshaft 148. In other embodiments, the timing of the intake and exhaust valves can be varied during operation so that the intake and exhaust events can be customized to changes in the operating conditions. Various ways of implementing variable valve timing are known in the art.

Figure 2:
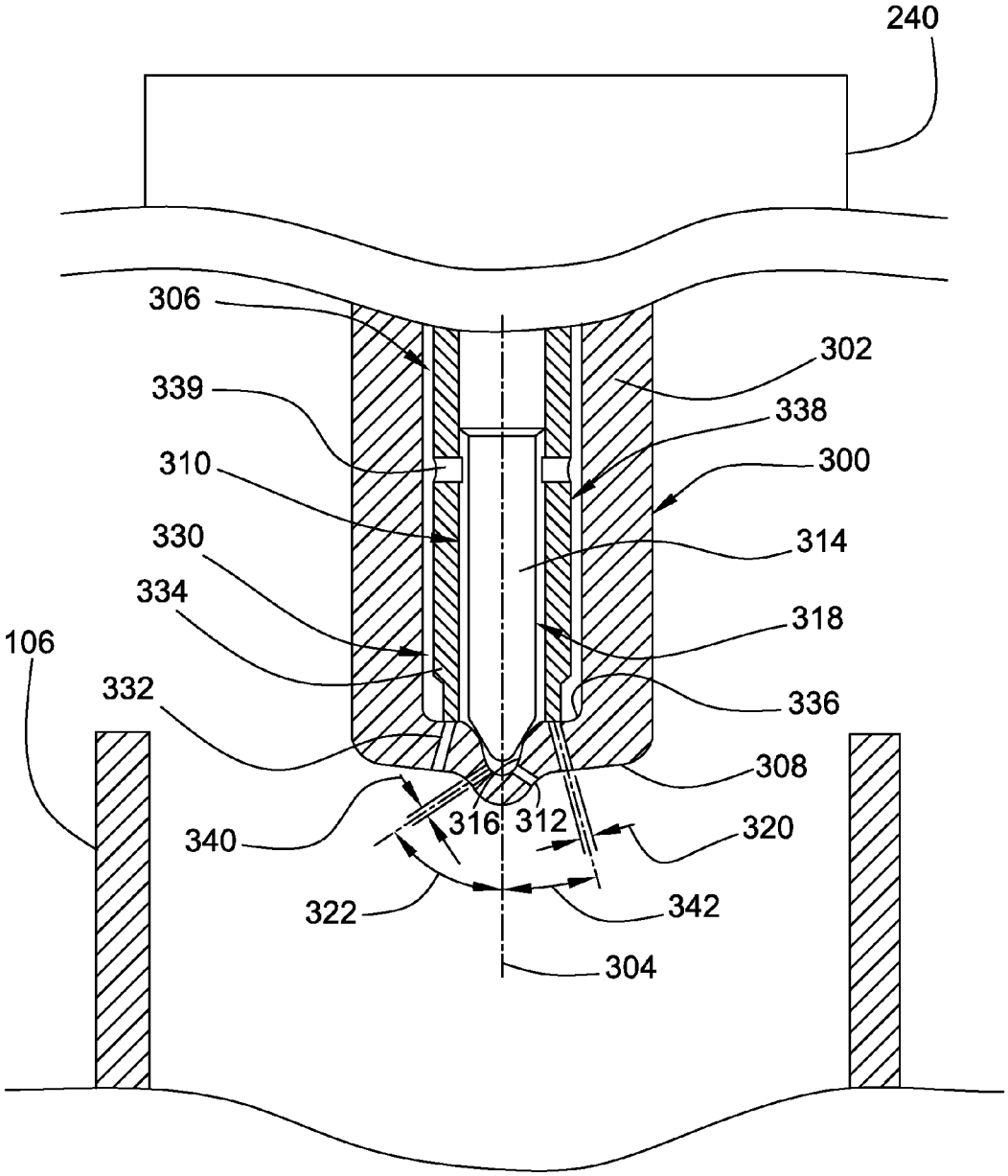
FIG. 2 is cross-sectional view of a dual-check fuel injector for introducing fuel to the combustion chamber having concentric checks for selectively introducing fuel through two or more different orifice sets.

Referring to FIG. 2, there is illustrated a fuel injector 300 of a type that can operate in conjunction with the injector controls 240 to introduce the first and second fuel charges in a manner that facilitates the six-stroke combustion process. In particular, the illustrated device is a dual-check injector 300 that is configured to introduce fuel through two different sets of orifices. The dual-check injector 300 includes an elongated, rod-like body 302 that extends generally along an injector axis line 304 and that can be partially disposed into the combustion chamber 106. The body 302 is substantially hollow so as to define an interior void 306 also aligned along the axis line 304 with one end of the body closed off by a distal wall 308. Disposed inside the interior void 306 are a first, inner check 310 and a second, outer check 330 arranged in a concentric manner and that can operate independent of each other to selectively open and close a first orifice set 312 and a respective second orifice set 332. In alternative embodiments, the two checks can be disposed adjacent one another or, in another alternative embodiment, two injectors may be used for each cylinder.

In the illustrated embodiment, to open and close the first orifice set 312, the first inner check 310 includes a first valve member 314 movable along the axis line 304 that can reciprocally move against and/or away from a first valve seat 316 disposed along the inner surface of the distal wall 308. The first orifice set 312 is disposed through the distal wall 308 and the first valve seat 316 and arranged in a manner that aligns the orifice or orifices with the distal end of the first valve member 314. Likewise, to open and close the second orifice set 332, the second outer check 330 can include a second valve member 334 movable along the axis line 304 and that can reciprocate against and/or away from a second valve seat 336 disposed on the inner surface of the distal wall 308 through which the second orifice or orifices 332 are disposed. The second valve member 334 can be formed as a hollow tube to accommodate the smaller diameter first valve member 314 within an inner lumen 318. Similarly, the second valve member 334 is loosely accommodated in the interior void 306 and sized to create a second outer lumen 338. The inner and outer lumens 318, 338 can channel or direct fuel parallel to the axis line 304 to the respective first and second orifice sets 312, 332. Further, to direct fuel to the inner lumen 318 from the outer lumen 338, one or more transverse apertures 339 can be disposed through the second valve member 334 perpendicularly to the axis line 304. Independent reciprocal motion between the first and second valve members 314, 334 can be actuated by the injector controller 240 coupled to the fuel injector 300. Accordingly, the first and second checks can be independently activated with respect to each other.

To produce the different first and second fuel charges, the first and second orifice sets 312, 332, which can work individually or in combination, can each include one or more orifices disposed through the distal wall 308 to communicate with the fuel-filled, interior void 306 when the respective first and second valve members 314, 334 are retracted. The first and second charges may be introduced as continuous streams or may each consist of multiple, discrete injections. In the illustrated embodiment, the first orifice set 312 can include a plurality of orifices, for example between five and nine orifices, disposed in a concentric circle around the axis line 304. The second orifice set 332 can include another plurality of orifices also disposed concentrically around the axis line 304 and radially outward of the first orifice set 312. The first and second orifice sets 312, 332 can be configured to differentiate the first and second fuel charges by, for example, volumetric fuel quantity or spray pattern. For example, the orifices of the first orifice set 312 can have or define a first orifice cross-sectional area 320 that is different from the orifices of the second orifice set 332 that may have or define a second orifice cross-sectional area 340. For the illustrated circular orifices, the first and second orifice cross-sectional areas 320, 340 may be derived from their diameters. However, the disclosure contemplates non-circular orifices in which the orifice cross-sectional areas may be calculated differently. In an embodiment, to cause the first charge to be larger than the second charge, the first orifice cross-sectional area 320 greater than the second orifice cross-sectional area 340 so that the first orifices introduce more fuel per given injection period with a wider cross-sectional spray area or jet per orifice. The first and second orifice sets can have any suitable diameter or size. For example, the first orifice set may be about 150 microns or greater and the second set may be about 150 microns or less, though other dimensions are contemplated.

To produce different spray patterns, the first and second orifice sets 312, 332 can be disposed into the distal wall 308 of the body 302 at different angles with respect to the axis line 304 or at different included angles. For example, the orifices of the first orifice set 312 can be each disposed at a first angle 322 relative to the axis line 304 while the orifices of the second set 332 are disposed at a second angle 342. The first angle 322 can be larger or smaller than the second angle 342 so that the resulting first spray pattern can be likewise wider or narrower than the second spray pattern. If the first and second orifice sets are arranged concentrically around the axis line, it may be appreciated that the first and second spray patterns will be generally conical, but in other embodiments, other spray patterns are contemplated.

Figure 3:
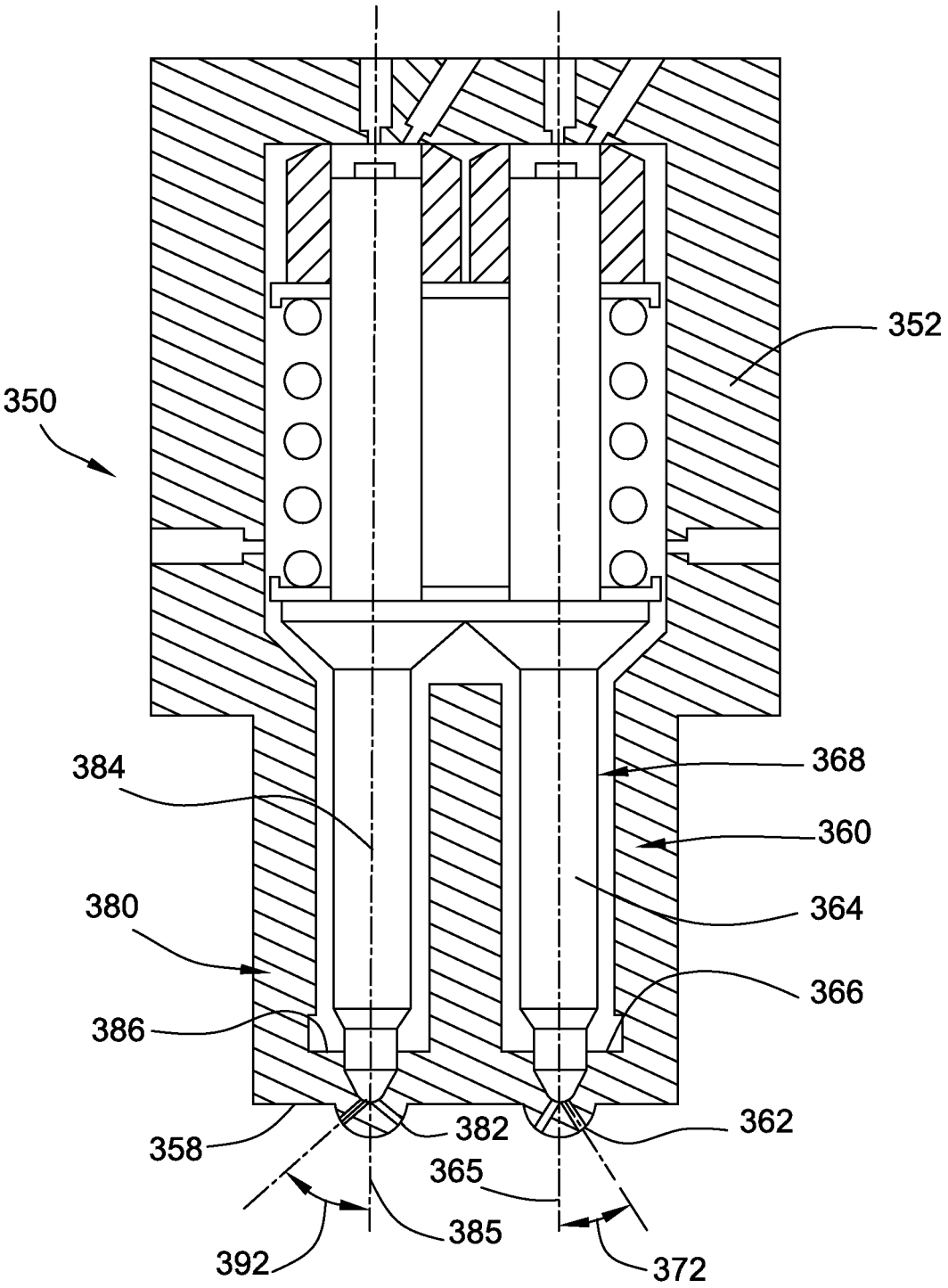
FIG. 3 is a cross-sectional view of a twin needle valve fuel injector having two needle valves arranged in a side-by-side configuration to selectively introduce fuel through two or more different orifice sets.

Referring to FIG. 3, there is illustrated another variation of a fuel injector for introducing different first and second fuel charges. The illustrated device can be a twin needle valve injector 350 having an injector body 352 housing a first nozzle assembly 360 and a second nozzle assembly 380 in a side-by-side arrangement. To form the first fuel charge, the first nozzle assembly 360 includes a first orifice set 362 disposed through the distal wall 358 of the injector body 352. To open and close the first orifice set 362, the first nozzle assembly 360 can also include a reciprocally movable, first needle valve 364 accommodated in a cylindrical cavity 368 and displaceable along a first axis line 365. The first needle valve 364 can thereby seat and unseat against a first valve seat 366 formed in the distal wall 358 at the terminal end of the first cavity 368 through which the first orifice set penetrates. The second nozzle assembly 380 can include a second orifice set 382 that can be opened and closed by a second needle valve 384 reciprocally movable along a second axis line 385 to seat and unseat with a second valve seat 386. In an embodiment, the arrangement of the second nozzle assembly 380 can generally mirror the first nozzle assembly 360 with the first and second axis lines 365, 385 parallel to one another.

To differentiate the first and second fuel charges, the first orifice set 362 can include a plurality of orifices arranged concentrically about the first axis line 365 that have a different size than the orifices of the second orifice set 382 arranged concentrically about the second axis line 385. Likewise, the first orifice set 362 can be disposed at a first angle 372 with respect to the first axis line 365 that is different from a second angle 392 at which the second orifice set 382 is disposed with respect to the second axis line 385. The different arrangements of the first and second orifice sets 362, 382 can determine in part the different volumetric quantities and spray patterns of the first and second fuel charges. Although the embodiments illustrated in FIGS. 2 and 3 have the first and second orifice sets disposed in the same fuel injector, it will be appreciated that in other embodiments, two different fuel injectors can be associated with each combustion chamber with each injector including one of the two different orifice sets.

Figure 12:
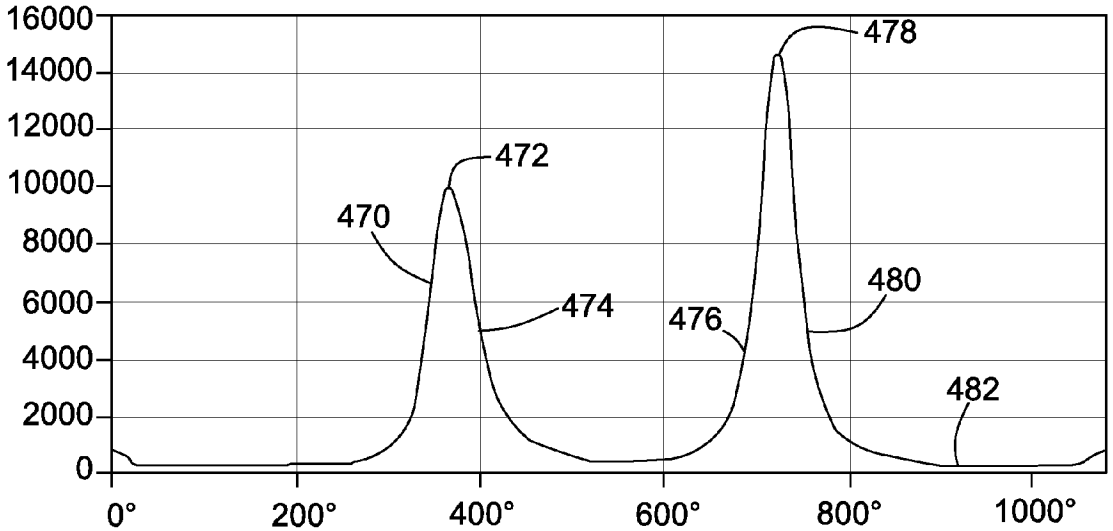
FIG. 12 is a chart illustrating a comparison of the internal cylinder pressure along the Y-axis in kilopascals (kPa) as measured against crankshaft angle along the X-axis as measured in degrees for a six-stroke combustion cycle.
Figure 11:
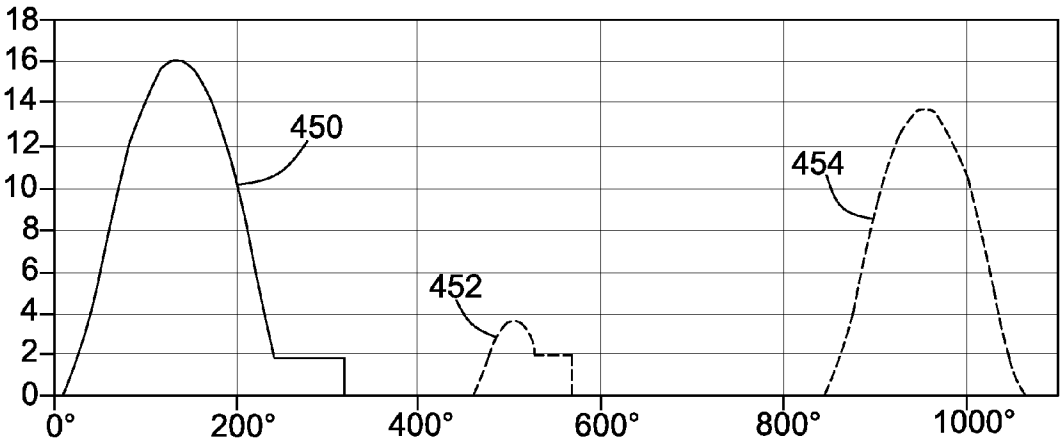
FIG. 11 is a chart representing the lift of the intake valve or valves and exhaust valve or valves in millimeters along the Y-axis as measured against crankshaft angle in degrees along the X-axis for a six-stroke combustion cycle.
Figure 13:
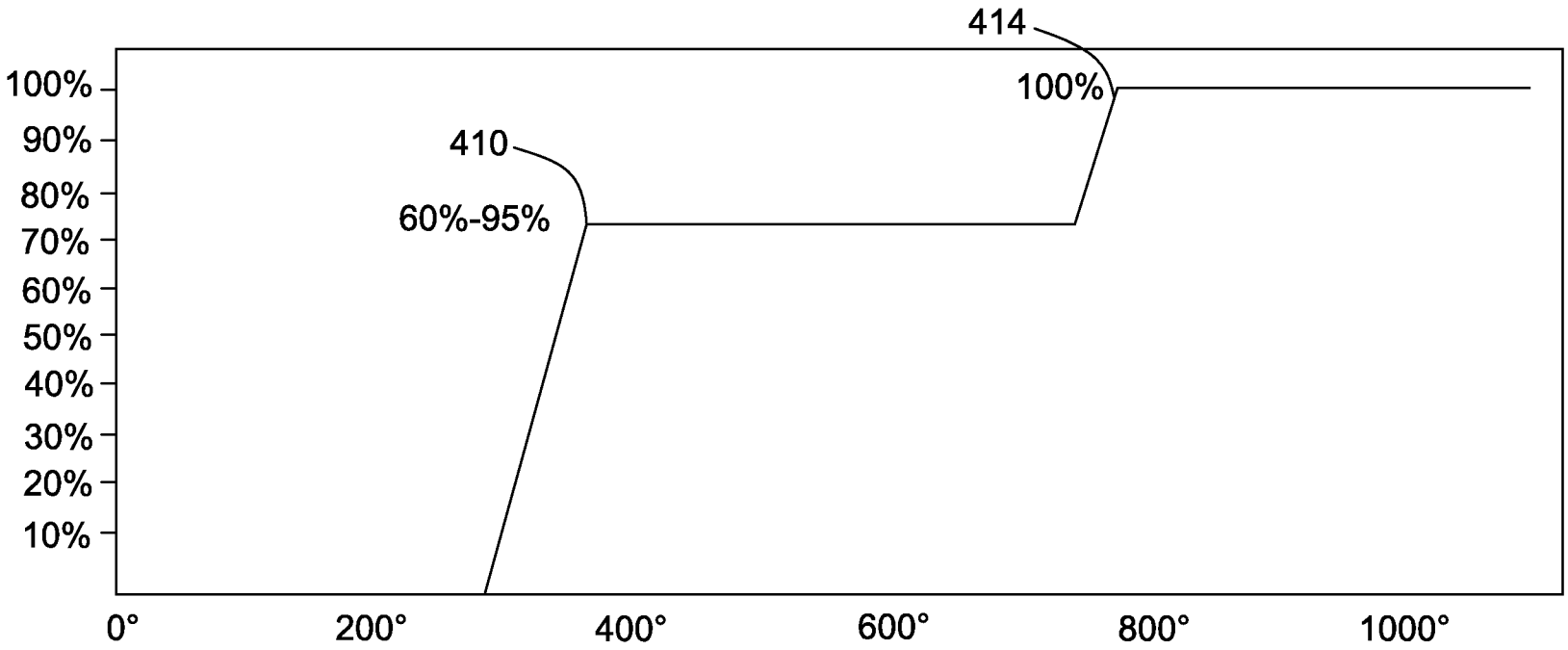
FIG. 13 is a chart illustrating the volumetric amount of fuel distribution between the first and second fuel charges as a percentage of the total cycle fuel charge on the Y-axis as measured against crankshaft angle along the X-axis for a six-stroke combustion cycle.

The different first and second fuel charges can be introduced to the combustion chamber 106 at different stages of the six-stroke process, which are illustrated in a representative series of stroke in FIGS. 4-10. FIG. 11 is a chart showing the valve lift in millimeters along the Y-axis compared to the crank angle in degrees along the X-axis. Lift of the intake valve is indicated in solid lines and lift of the exhaust valve in dashed lines. FIG. 12 depicts the cylinder pressure in kilopascals (kPa) along the Y-axis compared to crank angle in degrees along the X-axis. Likewise, FIG. 13 represents the amount of fuel introduced by the first and second fuel charges relative to the total amount of fuel introduced during the six-stroke cycle.

The actual strokes are performed by a reciprocal piston 400 that is slidably disposed in an elongated cylinder 402 bored into an engine block, or may alternatively be defined within a cylindrical sleeve installed into the cylinder block. The piston 400 may include a concaved bowl 401 disposed in its top surface. One end of the cylinder 402 is closed off by a flame deck surface 404 so that the combustion chamber 106 defines an enclosed space between the piston 400, the flame deck surface and the inner wall of the cylinder. Disposed through the flame deck surface 404 can be the fuel injector 122 and the intake and exhaust valves 136, 146, although in other embodiments these components can be disposed through other portions of the combustion chamber 106. The reciprocal piston 400 moves between the top dead center (TDC) position where the piston is closest to the flame deck surface 404 and the bottom dead center (BDC) position where the piston is furthest from the flame deck surface. The motion of the piston 400 with respect to the flame deck surface 404 thereby defines a variable volume 408 that expands and contracts.

Figures 4, 5, 6, 7, 8, 9, 10:
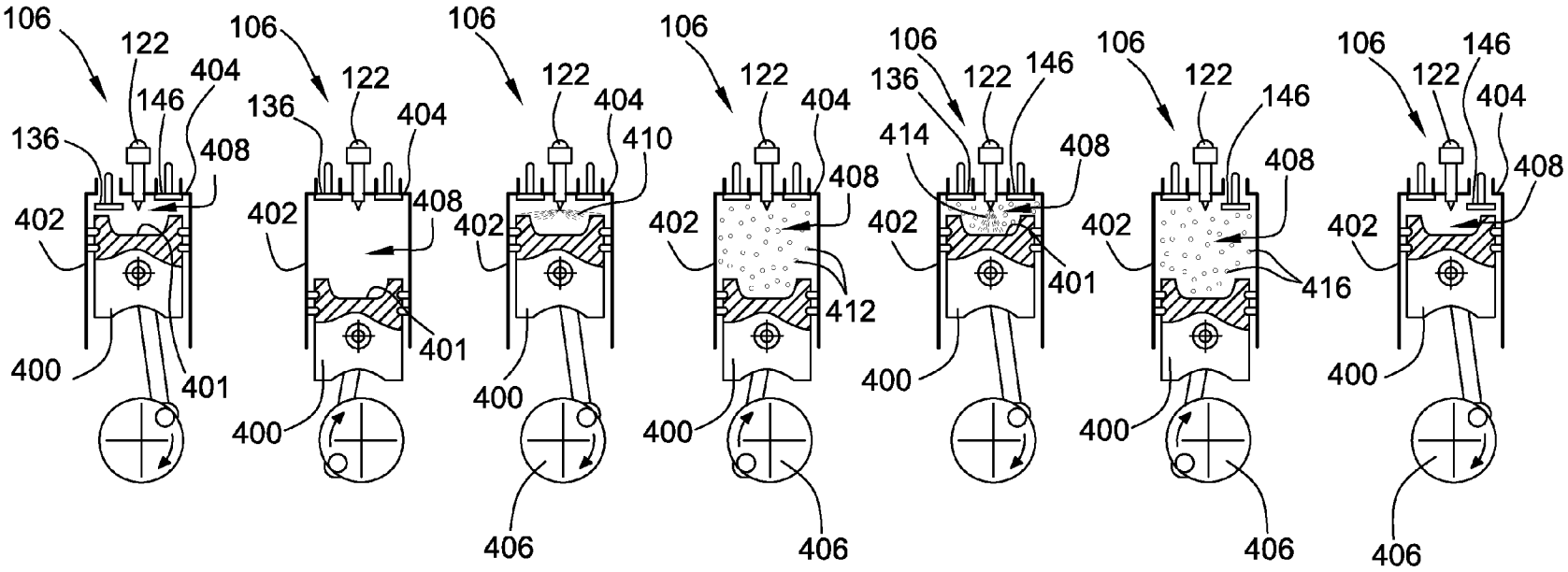
FIGS. 4-10 are cross-sectional views representing an engine cylinder and a piston movably disposed therein at various points during a six-stroke combustion cycle.

Referring to FIG. 4, the six-stroke cycle includes an intake stroke during which the piston 400 moves from the TDC position to the BDC position causing the variable volume 408 to expand. During this stroke, the intake valve 136 is opened so that air or an air mixture may enter the combustion chamber 106, as represented by the positive bell-shaped intake curve 450 indicating intake valve lift in FIG. 11. The duration of the intake valve opening may optionally be adjusted to control the amount of air provided to the cylinder. Referring to FIG. 5, once the piston 400 reaches the BDC position, the intake valve 136 closes and the piston can perform a first compression stroke moving back toward the TDC position and compressing the variable volume 408 that has been filled with air during the intake stroke. As indicated by the upward slope of the first compression curve 470 in FIG. 12, this motion increases pressure and relatedly temperature in the combustion chamber. In diesel engines, the compression ratio can be on the order of 15:1, although other compression ratios are common.

Referring to FIG. 6, the fuel injector 122 can introduce a first fuel charge 410 into the variable volume 408 to create an air/fuel mixture as the piston 450 approaches the TDC position. The quantity of the first fuel charge 410 can be selected so that the resulting air/fuel mixture is lean of stoichiometric, meaning there is an excess amount of oxygen from what is theoretically required to fully combust the quantity of fuel that was provided to the combustion chamber. Under stoichiometric conditions, the proportion of air and fuel is such that all air and fuel will react together with little or no remaining excess of either component. For diesel, the stoichiometric ratio of air to fuel can be about 14.7:1. A rich condition is the corollary in which excess fuel is present. Because the contents of the variable volume before the first fuel charge 410 will be substantially air having a significant ratio of combustible oxygen, the first fuel charge 410 can introduce a relatively large quantity of fuel by using, for example, the large diameter, first orifice set 312 of the dual-check fuel injector 300 in FIG. 2. Similarly, the first orifice set 362 of the twin needle fuel injector 350 of FIG. 3 can be used. In certain embodiments, referring to FIG. 13, the quantity of fuel introduced in the first fuel charge 410 can be about 60% to 95%, and possibly about 70% to 90% of the total fuel quantity introduced per cycle. This may result in a stoichiometric lean condition with an air/fuel ratio of about 30:1. Furthermore, introducing the first fuel charge 410 through the first orifice set may direct the fuel toward the piston bowl 401. For example, the first spray pattern can have a conical spray angle of about 120° to about 150° into the combustion chamber. In a possible embodiment, the second orifice set can also be activated with the first orifice set to provide the first fuel charge.

At an instance when the piston 400 is at or close to the TDC position and the first fuel charge 410 is introduced, pressure and temperature are at or near a first maximum pressure or peak pressure point, as indicated by point 472 in FIG. 12 and the air/fuel mixture may ignite. In embodiments where the fuel is less reactive, i.e., the fuel has a lower propensity to auto-ignite when compressed and heated, such as in gasoline burning engines, ignition may be induced by a sparkplug, by ignition of a pilot fuel or the like. During a first power stroke, the combusting air/fuel mixture expands forcing the piston 400 back to the BDC position as indicated in FIGS. 6 to 7. The piston 400 can be linked or connected to a crankshaft 406 so that its linear motion is converted to rotational motion that can be used to power an application or machine. The expansion of the variable volume 408 during the first power stroke also reduces the pressure in the combustion chamber 106 as indicated by the downward sloping first expansion curve 474 in FIG. 12.

At the conclusion of this stage, the variable volume 408 contains the resulting combustion products 412 that may include unburned fuel in the form of hydrocarbons (due to incomplete combustion), even though the air/fuel mixture in the chamber was lean. The variable volume may further include carbon monoxide, carbon dioxide, nitrogen oxides such as NO and $NO_2$ commonly referred to as $NO_X$, and excess oxygen from the intake air due to the lean conditions. Referring to FIG. 8, in the six-stroke cycle, the piston 400 can perform another compression stroke in which it compresses the combustion products 412 in the variable volume 408 by moving back to the TDC position. During the second compression stroke, both the intake valve 136 and exhaust valve 146 are typically closed so that pressure increases in the variable volume as indicated by the second compression curve 476 in FIG. 12. However, in some embodiments, to prevent too large a pressure spike, the exhaust valve 146 may be briefly opened to discharge some of the contents in a process referred to as blowdown, as indicated by the small blowdown curve 452 in FIG. 11. Additionally, in some embodiments, the intake valve might be opened briefly during the second compression stroke so that a portion of the combustion products 412 in the cylinder may be discharged into the intake manifold and can be reintroduced into the combustion chambers during subsequent intake strokes. Opening the intake valves during a compression stroke in the foregoing manner provides in a sense an internal EGR system in which exhaust gasses are reintroduced into the combustion chambers before the combustion event occurs.

When the piston 400 reaches, or is before or after the TDC position shown in FIG. 8, the fuel injector 122 can introduce a second fuel charge 414 into the combustion chamber 106 that can intermix with the combustion products 412 from the previous combustion event. Because the first combustion event will have consumed some of the oxygen, the quantity of fuel introduced in the second fuel charge 414 can be smaller, for example, the remaining 40% to 5%, and possibly 30% to 10%, of the total fuel amount as indicated in FIG. 13. The quantity can be selected to approach the stoichiometric condition but still be slightly lean. For example, the air/fuel ratio resulting from the second fuel charge 414 can between about 14.7:1 and about 22:1 and, more precisely, between about 17:1 and about 20:1. To controllably restrict the quantity of the second fuel charge 414, it can be introduced using the smaller, second orifice set 332 of the dual-check injector 300 of FIG. 2. Similarly, the second orifice set 382 of the twin needle valve injector 350 of FIG. 3 can be used. Hence, the second fuel charge 414 has a narrower included spray angle than the first fuel charge 410 illustrated in FIG. 6. In some embodiments, introducing the second fuel charge 414 through the second orifice set can direct the fuel charge in a different direction relative to the first charge 310. For example, second charge can be directed relatively more outwardly than the first charge that is directed more toward the bowl 401 in the top surface of the piston 400. In embodiments, the second fuel charge can be directed toward locations having a relatively higher concentration of oxygen with respect to the remainder of the variable volume 408.

In an embodiment, the smaller second orifice set 232 may help improve air entrainment of the second fuel charge. As can be appreciated, the diameter or cross-section of the orifice in the second orifice set can be designed so that the second fuel charge is introduced under a sufficiently high pressure and velocity. A portion of the fuel charge may be able to better disperse in the combustion chamber, either radially outwardly toward the wall of the cylinder 402 or downwardly into the bowl 410 of the piston, before igniting. The improved dispersion of the fuel charge may be beneficial because the pressures and temperatures in the combustion chamber may be higher after the first combustion event and the second compression cycle.

Referring to FIG. 12, when the piston 400 is proximate the TDC position, the pressure in the compressed variable volume 408 will be at a second maximum pressure or second peak pressure 478. The second peak pressure 478 may be greater than the first peak pressure 472 or may be otherwise controlled to be about the same or lower than the first peak pressure. At the second peak pressure 478, introduction of the second fuel charge 414 can spontaneously ignite with the previous combustion products 412. Referring to FIGS. 8 to 9, the second ignition and resulting second combustion expands the contents of the variable volume 408 forcing the piston 400 toward the BDC position resulting in a second power stroke driving the crankshaft 406. The second power stroke also reduces the pressure in the cylinder 402 as indicated by the downward sloping second expansion curve 480 in FIG. 11.

The second combustion event can further oxidize the unburned combustion products and particulate matter from the initial combustion event such as unburned fuel and soot. The quantity or amount of hydrocarbons in the resulting second combustion products 416 remaining in the cylinder 402 may also be reduced. Referring to FIG. 10, an exhaust stroke can be performed during which the momentum of the crankshaft 406 moves the piston 400 back to the TDC position with the exhaust valve 146 opened to discharge the second combustion products to the exhaust system. With the exhaust valve opened as indicated by the bell-shaped exhaust curve 454 in FIG. 11, the pressure in the cylinder can return to its initial pressure as indicated by the low, flat exhaust curve 482 in FIG. 12. Alternatively, additional recompression and re-combustion strokes can be performed in accordance with an 8-stroke, 10-stroke or like operating mode of the engine. While in disclosed embodiment, the first and a second orifice sets can be used to provide the first and second fuel charges for the first and second compression strokes in a six-stroke cycle, they can also provide preliminary and main charges during the same compression stroke.

INDUSTRIAL APPLICABILITY

Figure 14:
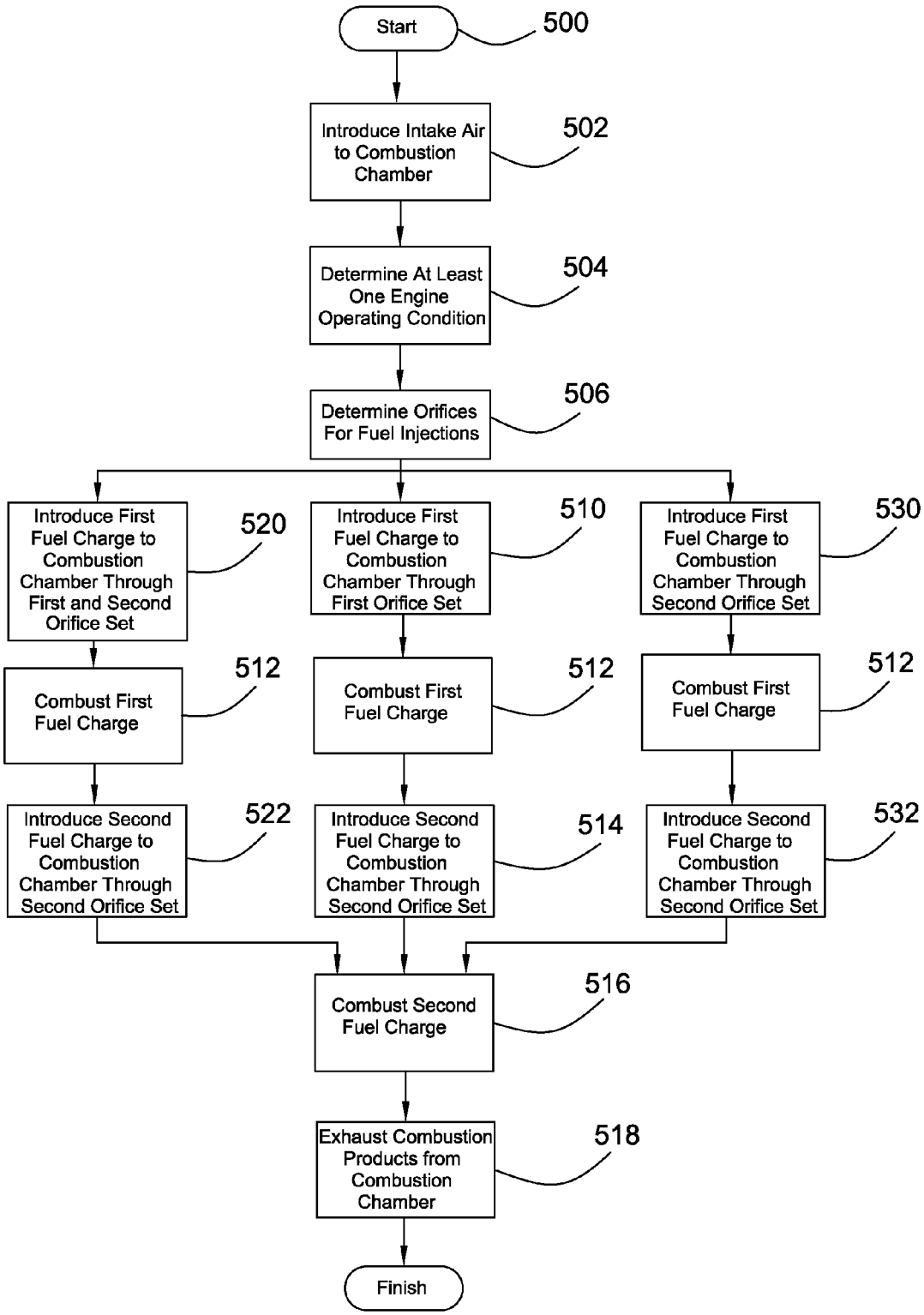
FIG. 14 is a schematic flow chart representing a possible routine or steps for operating a six-stroke engine using a fuel injector having two different orifice sets.

The present disclosure is applicable to internal combustion engines operating on a six-stroke cycle including introduction of first and second fuel charges. The first and second charges can be uniquely adapted to conditions and functions of the first and second combustion events, which may be different from each other. Referring to FIG. 14, there is illustrated a representative series of steps that the controller in FIG. 1 can perform by issuing appropriate instructive signals and directions to one or more fuel injectors associated with the combustion chamber. After an initial start step 500, intake air is directed to the combustion chamber in an intake step 502. The onboard controller can determine can assess and determine certain operating conditions or parameters of the internal combustion engine in a determination step 504. Based on the assessment in the determination step 504, the onboard controller can determine an injection strategy using the first and second orifice sets in a second determination step 506.

In one embodiment of the injection strategy, a first fuel charge can be introduced to the combustion chamber in a first introduction step 510 during the first compression stroke or early during the first power stroke. As described above, the first fuel charge can be introduced using a first orifice set of the fuel injector that is sized or arranged so that approximately about 60% to 95%, and possibly about 70% to about 90%, of the total fuel quantity consumed during the six-stroke cycle is introduced. Additionally, the first orifice set can be arranged so that the first fuel charge is directed toward the piston bowl. In a first combustion event 512, the first fuel charge and a portion of the intake air are combusted to produce the first power stroke. After the first combustion event, the contents in the combustion chamber can consist of the excess oxygen or air and unburned hydrocarbons and combustion products.

Accordingly, to reduce particulate matter, a second fuel charge is introduced in a second introduction step 514 using the second orifice set. The second fuel charge can be introduced during the second compression stroke or early in the second power stroke. The smaller, second orifice set can be sized and arranged to restrict the quantity of fuel introduced during the second fuel charge and to more optimally distribute the second fuel charge within the combustion chamber. For example, the second fuel charge can include the remaining 40% to 5%, possibly about 30% to 10%, of the total fuel amount. The second fuel charge and the combustion products from the first combustion event are combusted in a second combustion event 516 and the resulting combustion products can be exhausted from the combustion chamber in an exhaust step 518.

As mentioned above, in a possible alternative embodiment, the second orifice set can also be used in combination with the first orifice set to produce the first fuel charge in an alternative first introduction step 520, if so desired according to the fuel injection strategy. According to such an embodiment, the second fuel charge may be introduced to the combustion chamber through only the second orifice set in an alternative second introduction step 522. As a third embodiment, the first fuel charge may be introduced through only the second orifice set in a second alternative first introduction step 530. According to this embodiment, the second fuel charge may be introduced through the second orifice set in a second alternative second introduction step 532. In various other embodiments, various other combinations of orifices and introduction events may be used.

The size and orientation of the second orifice set can be different from the first orifice set so that the second fuel charge is more specifically adapted for the second combustion event and may attempt to address conditions or considerations that are different from the first combustion event. Because the second orifice set can have a smaller orifice area or diameter, it can result in better intermixing of fuel with the air remaining in the combustion chamber. Specifically, because the second fuel charge has a smaller quantity of fuel and the narrow jets or streams have a relatively increased surface area, the fuel may encounter more oxygen as it enters the combustion chamber. The quantity of fuel introduced during the second fuel charge may be better controlled due to the smaller orifice size of the second orifice set. Additionally, the second fuel charge might enter the combustion chamber at a higher relative velocity, thereby further improving the air/fuel mixture. Introducing the second fuel charge at higher velocities and/or pressures may improve air entrainment. In particular, the orifice size can be designed to produce the velocities and pressures required to produce sufficient flame lift-off length, the distance the fuel travels in the combustion chamber before it ignites. The improved mixing of fuel and oxygen can result in a more complete combustion leaving more time for soot oxidation. As a possible related advantage, because of the smaller size of the second orifice set, tolerances can be better maintained thereby providing better control over quantity or flow rate of the second fuel charge. In a further embodiment, the first and second fuel charges can be subdivided into preliminary and main fuel charge and the different sized orifice sets can be used to produce those additional charges. In other embodiments, during low engine load conditions such as idling, the second orifice set can be used as the primary orifice set for both the first and second fuel charge. The second orifice delivers a smaller quantity of fuel that, under low load or idle conditions, may be all the fuel that the engine requires.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. An internal combustion engine system operating on a six-stroke cycle including a first compression stroke and a first power stroke, and a second compression stroke and a second power stroke, the system including:

a combustion chamber including a piston reciprocally disposed in a cylinder to move between a top dead center position and a bottom dead center position through at least a first compression stroke, a first power stroke, a second compression stroke, and a second power stroke; and a fuel introduction system associated with the combustion chamber, the fuel introduction system including a first orifice set and a second orifice set both configured to introduce a hydrocarbon-based fuel, the first orifice set dedicated to introducing fuel only during at least one of the first compression stroke and/or the first power stroke, and the second orifice set introduces fuel during at least one of the first compression stroke and the first power stroke and at least one of the second compression stroke and the second power stroke.

2. The system of claim 1, wherein the first orifice set and the second orifice set are disposed in a first fuel injector of the fuel introduction system.

3. The system of claim 1, wherein the fuel introduction system includes a first fuel injector having disposed therein the first orifice set and a second fuel injector having disposed therein the second orifice set.

4. The system of claim 1, wherein the first orifice set includes at least one orifice of a first orifice cross-sectional area and the second orifice set includes at least one orifice of a second orifice cross-sectional area, the second orifice cross-sectional area smaller than the first orifice cross-sectional area.

5. The system of claim 4, wherein the first orifice cross-sectional area and the second orifice cross-sectional area are circular.

6. The system of claim 5, wherein the first orifice set introduces 60% to 95% of a total fuel combusted burned during the six-stroke cycle and the second orifice set introduces a remaining 40% to 5% of the total fuel combusted burned.

7. The system of claim 1, wherein the first orifice set has a first spray pattern, and the second orifice set has a second spray pattern, the first spray pattern different from the second spray pattern.

8. The system of claim 7, wherein the piston includes a top surface and a bowl disposed into the top surface, and the first spray pattern targets the bowl.

9. The system of claim 8, wherein the first spray pattern has an included angle of about 120° to about 150°.

10. The system of claim 1, wherein the second orifice set is dedicated to introducing fuel only during at least one of the second compression stroke and the second power stroke.

11. The system of claim 1, wherein the fuel introduction system includes a dual-check fuel injector including a first check and a second check concentrically arranged to each other, the first check and the second check independently movable with respect to each other to selectively open and close the first orifice set and the second orifice set respectively.

12. The system of claim 1, wherein the fuel introduction system includes a twin needle valve fuel injector including a first nozzle assembly having a first reciprocal needle valve and a second nozzle assembly having a second reciprocal needle valve, the first and second nozzle assemblies arranged in a side-by-side configuration, the first and second reciprocal needle valves independently movable to selectively open and close the first orifice set and the second orifice set respectively.

13. A method of operating an internal combustion engine utilizing a six-stroke cycle, the method comprising:

providing a combustion chamber including a piston movable in a cylinder through at least a first compression stroke, a first power stroke, a second compression stroke, and a second power stroke;

introducing a first hydro-carbon based fuel charge to the combustion chamber through a first orifice set only during at least one of the first compression stroke and the first power stroke; and introducing a second hydrocarbon-based fuel charge to the combustion chamber through a second orifice set during at least one of the first compression stroke and first power stroke and during at least one of the second compression stroke and the second power stroke.

14. The method of claim 13, wherein the first orifice set and the second orifice set are disposed in a first fuel injector operatively associated with the combustion chamber.

15. The method of claim 13, wherein the first orifice set is disposed in a first fuel injector operatively associated with the combustion chamber and the second orifice set is disposed in a second fuel injector operatively associated with the combustion chamber.

16. The method of claim 13, wherein the first orifice set includes at least one orifice of a first orifice cross-sectional area and the second orifice set includes at least one orifice of a second orifice cross-sectional area, the second orifice cross-sectional area smaller than the first orifice cross-sectional area.

17. The method of claim 16, wherein the first orifice set introduces the first hydrocarbon-based fuel charge, and the second orifice set introduces the second hydrocarbon-based fuel charge, a quantity of the second hydrocarbon-based fuel charge of a lesser being less than a quantity of the first hydrocarbon-based fuel charge.

18. The method of claim 13, wherein the first fuel charge produces a first stoichiometric lean stoichiometry condition in the internal combustion chamber, and the second fuel charge produces a second stoichiometric lean stoichiometry condition, the second stoichiometric lean stoichiometry condition being closer to stoichiometric than the first stoichiometric lean stoichiometry condition.

19. An internal combustion engine system operating on a six-stroke cycle, the system comprising:

a combustion chamber having a piston reciprocally disposed in a cylinder, the piston movable through a first compression stroke, a first power stroke, a second compression stroke, and a second power stroke;

a fuel injector communicating with the combustion chamber, the fuel injector including a first orifice set and a second orifice set both configured to introduce a hydrocarbon-based fuel;

a controller controlling the fuel injector to open the first orifice set only during at least one of the first compression stroke and the first power stroke and to open the second orifice set during at least one of the first compression stroke and first power stroke and during at least one of the second compression stroke and the second power stroke.

20. The internal combustion engine system of claim 1, wherein the fuel introduction system is in fluid communication with a single fuel reservoir for supplying the hydrocarbon-based fuel to both the first orifice set and the second orifice set.

* * * * *